US005156100A

United States Patent [19]

Pentti

[11] Patent Number: 5,156,100

[45] Date of Patent: Oct. 20, 1992

[54] METHOD AND APPARATUS FOR STARTING THE BOILER OF A SOLID-FUEL FIRED POWER PLANT AND ENSURING THE BURNING PROCESS OF THE FUEL

[75] Inventor: Salmelin Pentti, Helsinki, Finland

[73] Assignee: Imatran Voima Oy, Helsinki, Finland

[21] Appl. No.: 720,478

[22] PCT Filed: Jan. 12, 1990

[86] PCT No.: PCT/FI90/00012

§ 371 Date: Jul. 9, 1991

§ 102(e) Date: Jul. 9, 1991

[87] PCT Pub. No.: WO90/08289

PCT Pub. Date: Jul. 26, 1990

[30] Foreign Application Priority Data

Jan. 16, 1989 [FI] Finland ..... 890220

[51] Int. Cl.[5] ..... F23D 1/00

[52] U.S. Cl. ..... 110/347; 110/263; 110/264

[58] Field of Search ..... 110/263, 264, 347

[56] References Cited

U.S. PATENT DOCUMENTS 4,221,174 9/1980 Smith et al. ..... 110/263 X
4,241,673 12/1980 Smith et al. .
4,279,206 7/1981 Pitts et al. .
4,474,120 2/1984 Adrian et al. .
4,862,814 9/1989 Campbell et al. ..... 110/264
4,991,520 2/1991 Tsumura et al. ..... 110/263

FOREIGN PATENT DOCUMENTS 0303522 2/1989 European Pat. Off. .
3441358 12/1985 Fed. Rep. of Germany .
60194211 10/1985 Japan .
2160218 6/1984 United Kingdom .

OTHER PUBLICATIONS

ASME article "Plasma Arc Ignition of Pulverized Coal", Cioffi et al., pp. 1-5.
ASME article "Plasma Arc Pulverized Coal Ignition Demonstration Tests", Paley et al., pp. 1-7.
Article "Get Oil and Gas Out of Pulverized-Coal Firing" John Reason.
Article "Plasma Totch Boiler Ignition", pp. D.2-1 to D.2-10; Oct. 1982.
Article "Plasma Torches as Replacement for Oil Burners" Thunberg et al., pp. 207-211 from Iron and Steel International Dec. 1983.

*Primary Examiner*—Edward G. Favors

[57] ABSTRACT

A method and apparatus starts the boiler of a solid-fuel fired power plant and ensures the burning process of the fuel. The main fuel of the boiler is ignited by entering an auxiliary fuel stream gasified and ignited with a plasma torch (1). Efficient mixing and safe ignition of the main fuel with the auxiliary fuel is ensured by a turbulent feed of the auxiliary fuel and a nozzle (12) through which the auxiliary fuel is entered into the main fuel stream.

14 Claims, 4 Drawing Sheets

METHOD AND APPARATUS FOR STARTING THE BOILER OF A SOLID-FUEL FIRED POWER PLANT AND ENSURING THE BURNING PROCESS OF THE FUEL

BACKGROUND OF THE INVENTION

The present invention relates to a method for starting the boiler of a solid-fuel fired power plant and for ensuring the burning process of the fuel.

The invention also concerns an apparatus used for the implementation of the method.

DESCRIPTION OF THE BACKGROUND ART

Solid-fuel fired boilers of power plants are provided with several burners. The primary proportion of the boiler energy output is produced by main burners which deliver the major quantity of fuel used for firing the boiler. In boilers fired with a low-grade solid fuel, the continuous combustion of the fuel must be ensured, since extinction of the fire causes an explosion hazard through the gasification of the fuel in the hot boiler into a gas containing explosion-susceptible carbon monoxide. The continuous combustion of fuel is ensured by means of auxiliary torches. The auxiliary torches typically are different kinds of oil or gas torches.

A boiler fired with a solid fuel such as coal or peat is started (also called "warm-up") by heating the boiler to a sufficient heat by the igniting torches, after which the feed of the solid fuel into the boiler can be initiated. The capacity of the igniting torches necessary in the process must be relatively high in relation to the total capacity of the boiler in order to make the starting operation possible. As a rule, the igniting torches are dimensioned so that their capacity is approx. 25 . . . 50% of the total capacity of the boiler.

The igniting burners conventionally used are gas or oil torches, which simultaneously function as combustion supporting torches. The main burner in the boiler is mounted to an opening in the boiler wall, while the igniting auxiliary torch is placed in the center of the main burner. During the warm-up phase the boiler is heated by the auxiliary torch flame. When required, the igniting torch is used in the steady-state operation of the boiler as an auxiliary burner in the purpose of ensuring the continuous combustion of the main fuel. The function and construction of different kinds of gas and oil torches is well known in the art.

The use of plasma torches as auxiliary and/or igniting burners has been investigated, yet wider use of these apparatuses is still unseen. Further, the direct use of arc-ignited pulverized coal for the ignition and auxiliary firing of the boiler is also being investigated, but equipment based on this idea is neither yet applicable at the scale of power plants. The state of the art is elucidated in the following publications

[1] Plasma torches as replacement for oil burners, S. L. Thunberg, W. J. Melilli, W. H. Reed, Energy, Iron and Steel International, December 1983, pp. 207 . . . 211.

[2] Plasma torch boiler ignition, M. B. Paley, Babcock and Wilcox Canada, Industrial opportunities for plasma technology, Symposium in Toronto, Oct. 21, 1982, D-2, 15 pp.

[3] Get oil and gas out of pulverized-coal firing, John Reason, Fuels and fuel handling, Power, May 1983, pp. 111 . . . 113.

In addition to the above described implementations, an auxiliary burner based on multistage firing is known in the art in which the coal acting as the auxiliary fuel is delivered into the flame of a gas torch. The fuel mix delivered into the torch flame is air-deficient, whereby the auxiliary air required for complete combustion is fed into the stream of the auxiliary fuel through a separate adapter. Conventionally used ignitor and auxiliary burner constructions based on oil or gas torches have a simple structure and achieve a well-behaved control of the combustion process by means of these burners. The disadvantage of these systems is, however, that the torch uses a different fuel from that used for firing the boiler, whereby a separate fuel feed and storage system must be constructed for the torch. Oil and gas are priced above conventionally used solid fuels, and since the capacity of ignitors and auxiliary burners must be relatively high in relation to the total capacity of the boiler, they consume the high-priced fuels in abundance, thereby raising the operating costs of the plant. The combustion of large quantities of oil in conjunction with the use of a solid fuel appreciably increases the sulfur release rate of the plant, since the oil grades conventionally used contain substantially more sulfur than the conventionally used solid fuels. In peat-fuelled power plants in particular, the contribution of oil-related sulfur is high in the total sulfur releases of the plant, because the oil torch must be used continuously in the steady-state operation of the boiler, thus nullifying the low sulfur content of peat. The combustion process of peat is difficult to control due to large variations in the moisture content and other combustion-related properties of peat. The major proportion of sulfur releases from a peat-fired boiler is thus traceable to the oil used in the auxiliary burner.

Auxiliary burners and ignitors based on plasma technology are hampered by their deficient capacity and small size of the plasma torch flame, therein making the combustion process of the main fuel difficult to control by means of these apparatuses. The cold-start characteristics of plasma-ignited burners are poor. Burners known in the art have been unsuccessful in achieving a sufficient efficiency in the blending of the plasma flame with the fuel as to ensure a safe ignition of the fuel in cold-start conditions. These apparatuses are incapable of safely starting a cold boiler, making it impossible to use them as a replacement to a conventional igniting torch. Firing with low-grade fuels necessitates the use of an oil or gas supplementary burner to complement a plasma-ignited auxiliary burner.

An arc-ignited burner is applicable only as the main burner of a boiler. According to this method, electrodes are introduced into the fuel stream of the main burner, an arc is initiated between the electrodes, and after the ignition of the fuel, the arc is extinguished and the electrode structure is withdrawn from the fuel stream.

A disadvantage of a multistage gas-ignited burner is that the gas torch is incapable of generating a sufficiently hot and concentrated flame, which could achieve an efficient gasification of the auxiliary fuel mixture in sufficiently air-deficient conditions. The combustion air required by the gas torch further promotes combustion of the auxiliary fuel already in the first stage of air feed. Consequently, the gas-ignited burner fails to achieve a sufficiently efficient multistage burner. In spite of the multistage combustion, the sulfur emissions from this kind of a burner are relatively high and the burner is unstable in operation. In addition, this type of burner cannot achieve an efficient initial operation of multistaged combustion at burner ignition.

Nitrogen oxide emissions from other types of burners described above are slightly higher than those of a gas-ignited multistage burner.

SUMMARY OF THE INVENTION

The aim of this invention is to achieve a plasma technology based auxiliary and igniting burner construction, capable of being used as a replacement for conventionally used oil and gas burners with significant concurrent reduction in nitrogen oxide emissions.

The auxiliary and igniting burner in accordance with the invention is later called the PC (plasma-coal) burner in short.

The invention is based on gasifying and igniting a portion of the auxiliary fuel by means of a plasma torch and then delivering this auxiliary fuel coaxially to the center of the main fuel stream, whereby a low energy output of the plasma torch is sufficient for the gasification and controlled ignition of a large quantity of delivered auxiliary fuel. According to the invention, it is feasible to achieve an auxiliary and igniting burner with such a high capacity and easy controllability that boiler warm-up with this burner is possible.

More specifically, the method in accordance with the invention is characterized by routing auxiliary fuel into an air-deficient gasification zone in the flame of a plasma torch burning in front of the torch. The auxiliary fuel is gasified and partially combusted, therein allowing the combustion energy of the auxiliary fuel to gasify more auxiliary fuel. The degree of gasification of the auxiliary fuel is controlled by feeding air into the auxiliary fuel at least in one stage. The gasified, partially burning and air-deficient mixture of auxiliary fuel is ignited by feeding air into the mixture. Then, the auxiliary fuel stream is entered into the main fuel stream in order to ignite the main fuel.

Furthermore, the apparatus in accordance with the invention is characterized by a body tube extending essentially coaxially with the center axis of the main burner, for feeding the auxiliary fuel into the main fuel stream. A nozzle is positioned on the boiler-side end of the body tube for feeding the auxiliary fuel stream into the main fuel stream. A space is adapted between the plasma torch and the coaxially aligned body tube, for feeding the auxiliary fuel into the plasma flame burning in the space between the plasma torch and the body tube. At least one air feed adapter for feeding air into the auxiliary fuel stream is provided to control its degree of gasification. An air feed adapter feeds secondary air into the air-deficient auxiliary fuel stream in order to achieve its final ignition.

The invention provides outstanding benefits.

The apparatus in accordance with the invention permits the replacement of oil and gas burners earlier used as auxiliary burners and ignitors. Because the PC burner uses a solid fuel, the provision of storage and feed equipment for oil or gas can be avoided. The operating costs of the power plant are reduced by the use of a low-price fuel in the auxiliary burner and the management of fuel storage becomes easier by virtue of the reduced number of stored fuels. The proportion of electrical energy required by the plasma torch is small in relation to the total capacity of the PC burner. Reduced sulfur oxide emissions particularly in peat-fuelled power plants are experienced when an oil burner is replaced by a plasma-ignited solid-fuel burning PC burner. Since the apparatus in accordance with the invention is a multistage burner, the emissions of nitrogen oxides can be maintained by the methods of multistage combustion at a low level equal or even better than that achievable with conventional auxiliary burners. With the use of the plasma torch for gasification and ignition of the auxiliary fuel, sufficient energy can be introduced to the gasification zone of the burner for the achievement of effective gasification in the burner and thereby improved multistage combustion over conventional burners. Through the use of this kind of a burner, the nitrogen oxide emissions can even be reduced by using such a gas, preferably nitrogen, as the plasma-forming gas that later forms single-atom radicals in the plasma flame. Hence, a significant reduction of nitrogen oxide emissions is the dominant benefit of the present invention.

The flame of the PC burner is easily controllable and steady burning even at low energy output levels. By virtue of its stable burning characteristic, the energy output level of the PC burner is easily controlled by adjusting the fuel feed rate. Therefore, the PC burner is suitable for use as an igniting burner in all solid-fuel fired boilers as well as the boiler output regulating burner. The PC burner in accordance with the present invention achieves main fuel use in coal- or peat-fuelled boilers over a vastly wider range of boiler capacity and at lower operating levels of energy output than is possible with the conventional technology. With the safe and economical control of the plant energy output, the plant can be used for peak-clipping in the distribution network by way of being fired by the main fuel alone. The construction of the PC burner in accordance with the invention is such that the continuous burning of the fuel used in the burner is ensured by means of a plasma torch, whereby the boiler can use difficult-to-burn fuels such as wood chips, lignin, etc. as the main fuel. Due to the extremely reliable operation and easy controllability of the PC burner, the main burners can be supported by the PC burners without the supplementary use of oil or gas torches, since the risk of fire extinction and subsequent explosion hazard is extremely small.

The present burner can be installed in new boilers or it can be used for replacing the ignitors and auxiliary burners of an existing boiler. No major changes are required in the boiler construction, because the present boiler can be built so small in size that it can be mounted in conjunction with the existing main burner as a replacement for the dismantled auxiliary burner and its ancillaries.

Further scope of applicability of the present invention will become apparent from the detailed description given hereinafter. However, it should be understood that the detailed description and specific examples, while indicating preferred embodiments of the invention, ar given by way of illustration only, since various changes and modifications within the spirit and scope of the invention will become apparent to those skilled in the art from this detailed description.

BRIEF DESCRIPTION OF THE DRAWINGS

The invention is next examined in detail with the help of attached drawings which are given by way of illustration only, and thus are not limitative of the present invention.

DETAILED DESCRIPTION OF THE PREFERRED EMBODIMENTS

According to the present invention, a plasma torch 1 is used for gasification of a solid fuel, for instance, dense-phase pulverized coal. The degree of combustion-gasification ratio of the coal and air mixture is controlled by means of multistaged air feed. The partially gasified and burning air-deficit mixture containing hot coal particles, carbon monoxide and hydrogen is fed into the fuel stream of a main burner 6, whereby the main fuel is ignited. Air is fed to the ignition zone in order to improve the combustion process.

Figure 1:
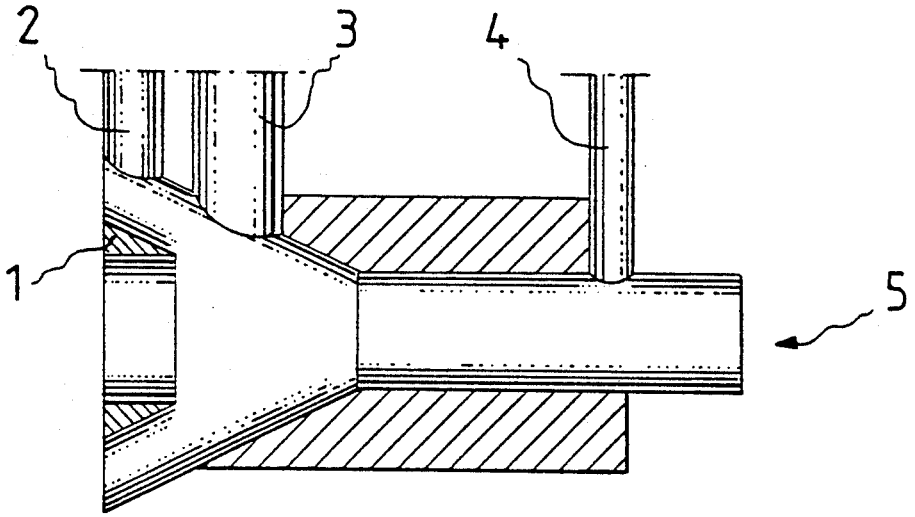
FIG. 1 shows diagrammatically the basic components of an apparatus in accordance with the invention.

FIG. 1 illustrates the operating principle of the present invention. The plasma torch 1 is adapted to the conical rear part of a burner 5. The burner 5 is fed with air-entrained dense-phase pulverized coal entering via an adapter 2. The dense-phase pulverized coal is conveyed around the plasma torch 1 to the front of the torch 1, where the hot plasma flame gasifies a part of the pulverized coal into carbon monoxide simultaneously igniting the combustion of pulverized coal and carbon monoxide. The burning carbon monoxide further gasifies more coal particles and thus augments the effect of the plasma flame. Temperature in this gasification zone is locally above 3500° C., preferably above 4000° C., sufficiently high to dissociate a portion of the nitrogen gas used as the plasma-forming gas into radicals. The air volume required in this stage as carrier for the fuel is so small that the coal-air mixture entering the gasification zone in front of the plasma torch 1 is extremely air-deficient. Secondary air is introduced to the fuel stream via an adapter 3 in order to control the degree of fuel gasification. Air is mixed with the fuel only sufficiently to allow a portion of the coal to be gasified into carbon monoxide. The burning gas containing carbon monoxide, hydrogen and hot coal particles in abundance is blown along a tube into the fuel stream of the main burner. Gasification of the fuel can be further controlled by adding tertiary air in the fuel stream through an adapter 4.

The combination of the plasma torch 1 and the multistage combustion technology results in a burner, whose nitrogen oxide emissions are extremely low. In conventional burners, nitrogen oxides are generated in those zones of the flame that have a high temperature. The PC burner avoids the formation of nitrogen oxides, since the plasma is generated without combustion air or fuel. Consequently, the plasma zone operates without oxygen necessary for the formation of nitrogen oxides. The flame of the plasma torch 1 is extremely hot, thereby being capable of transferring a large quantity of energy into the auxiliary fuel mixture.

Heat generation in the gasification zone is further improved by the partial combustion of the auxiliary fuel. When nitrogen is used as the plasma-forming gas, it dissociates in the gasification zone from a diatomic gas into single-atom radicals. These radicals then react with the nitrogen oxides, whereby diatomic nitrogen and oxygen gases are formed. The later combustion stages subsequent to the plasma torch have such conditions as to allow the formed single-atom radicals and nitrogen oxides to react with each other. The resulting combustion flue gases contain extremely small quantities of nitrogen oxides, whereby nitrogen oxide emissions from the burner remain very low.

Figure 2:
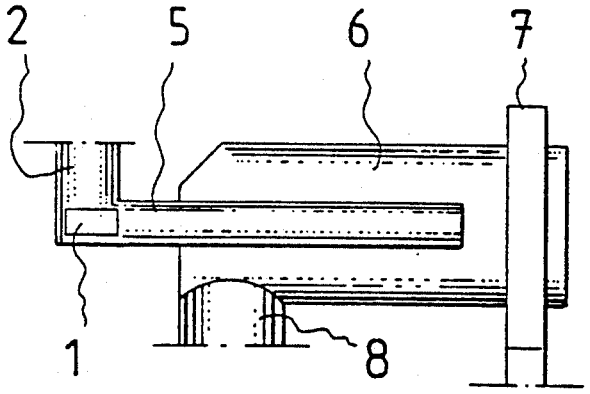
FIG. 2 shows diagrammatically an apparatus in accordance with the invention installed in conjunction with a main burner.

Illustrated in FIG. 2 is an example of the adaptation of the apparatus in conjunction with a main burner 6. The PC burner 5 is aligned parallel with the center axis of the main burner 6 so that the PC burner 5 is coaxially constructed to the center axis of the main burner 6. Fuel is introduced to the PC burner 5 via an adapter 2 and the fuel is ignited by the plasma torch 1. The fuel of the main burner 6 enters via an adapter 8 and the combustion air required by the main burner 6 is routed to the burner 6 via an air duct adapter 7.

Figure 3:
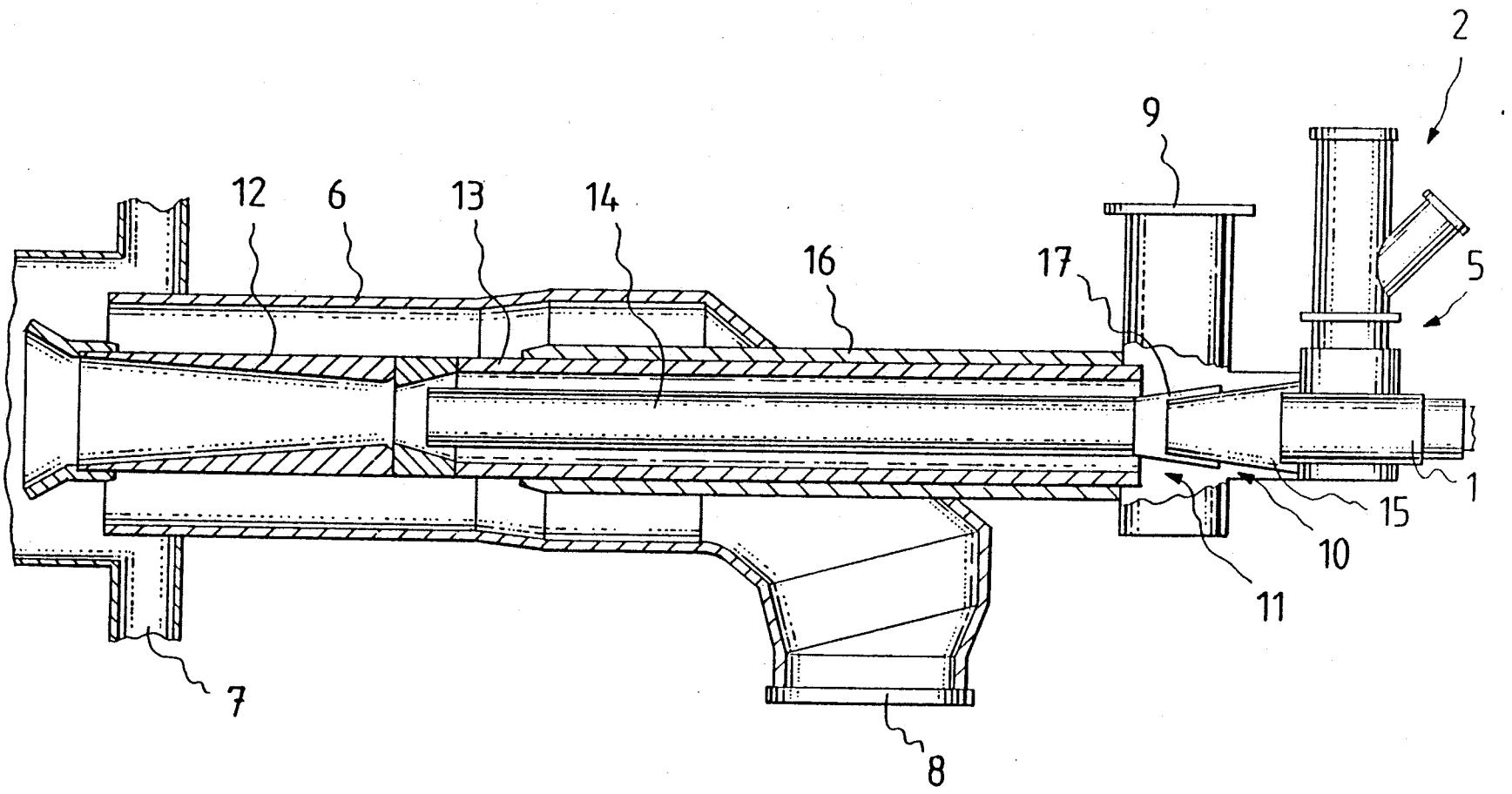
FIG. 3 shows a detailed sectional drawing of an embodiment of the present apparatus installed in conjunction with a main burner.

Illustrated in FIG. 3 is an embodiment of the present invention. In addition to the PC burner 5 and the main burner 6, the apparatus comprises fuel and air adapters 2, 7, 8, 9, the plasma torch 1, air conduction slots 10, 11 and a nozzle 12 of the auxiliary burner. The main burner 6 is mounted on the wall of the boiler. The PC burner 5 is constructed to the center axis of the main burner 6 and the end of the nozzle 12 protrudes further into the boiler than the orifice of the main burner 6. The nozzle 12 of the PC burner 5 is attached to the boiler-side end of a body tube 13. The body tube 13 of the PC burner 5 enters the main burner space through the wall of the main burner 6 within a protective sheath 16. The entrance-side end of the protective sheath 16 and the body tube 13 is provided with a combustion-air feed adapter 9. The feed adapter 9 carries the attached plasma torch 1 and fuel feed adapters 2 of the PC burner 5.

The plasma torch 1 is DC excited using nitrogen as the plasma-forming gas. The plasma torch is water-cooled. Dense-phase pulverized coal used as the fuel is delivered to the front of the plasma torch 1 via the adapter 2. The fuel is fed air-entrained by means of a blower. The end of the fuel feed adapter 2 joining to the auxiliary burner 5 is rounded into a jacket enveloping approximately a half turn around the body. Because of the rounded shape of the end of the adapter 2, the pulverized coal entering the PC burner 5 is made to swirl about the center axis of the PC burner 5. The developing turbulence promotes the mixing of the pulverized coal with air and the gasification of the coal in the first air feed stage. The turbulent flame and convection of the gas flow promote the mixing of the main fuel with the gas stream entering from the PC burner and thereby achieve the ignition and steady combustion of the main fuel stream.

Adapted in front of the plasma torch 1 are air conduction slots 10 and 11. By varying the quantity of air flowing through the air conduction slots 10 and 11, the degree of fuel gasification can be varied in the different stages. The first air conduction slot 10 is formed between a feed tube 14 and a nozzle cone 15. The nozzle cone 15 in front of the plasma torch 1 forms a space in which the pulverized coal is ignited and partially gasified into carbon monoxide by the effect of the plasma torch. The plasma torch can be operated in a sustained or intermittent mode in the burner. The air quantity required as carrier for pulverized coal delivery is so small that a low content of carbon monoxide is formed in this stage. From the nozzle cone 15 the coal-air mixture is ejected into the feed tube 14. At the end of the nozzle cone 15, secondary air is introduced via the air conduction slot 10, whereby more carbon monoxide is formed. The formed mixture is then conducted along the feed tube 14 to the nozzle 12. The entrance of the nozzle 12 at the joint with the discharge end of the feed tube 14 is fed with air directed along the second air conduction slot 11. With the help of this secondary air, the combustion of the mixture discharging from the feed tube 14 is accelerated The partially burning gas containing carbon monoxide, hydrogen and hot coal particles in abundance is ejected through the nozzle 12 into the fuel stream of the main burner 6. The purpose of the nozzle 12 is to achieve a flame whose blending with the main fuel stream takes place at maximum efficiency. The blending of the main fuel with the flame of the auxiliary burner 5 is promoted by the swirl motion of the gas stream discharging from the auxiliary burner 5 about the center axis of the burner.

The auxiliary burner has a multistage structure, in which the required combustion air is introduced in several stages. A feed adapter 9 of the combustion air is mounted to the entrance end of the body tube 13 in the auxiliary burner 5. The air feed adapter 9 is a jacket enveloping a conical end 17 of the feed tube 14 and the nozzle cone 15. The air feed adapter 9 thus forms a cavity, which contains the entrance ends of the air conduction slots 10 and 11. The first slot 10 discharging at the front of the nozzle cone 15 starts from between the conical end 17 of the feed tube 14 and the nozzle cone 15. The second slot 11 discharging at the entrance end of the nozzle 12 is formed between the feed tube 14 and the body tube 13. The body tube 13 is lined with a protective sheath 16. The purpose of multistage combustion is to reduce the nitrogen oxide emissions from the combustion process. The formation of nitrogen oxides is reduced by maintaining reducing conditions at the stage of flame ignition where high temperatures are encountered. The combustion temperatures in the final combustion of the main fuel stream can be kept low by means of the multistage combustion technology, thereby achieving a low level of nitrogen oxide formation.

The energy output level of the PC burner 5 is controlled by regulating the feed rate of pulverized coal. The energy output of the plasma torch 1 is maintained constant. Because the plasma torch is capable of igniting the pulverized coal delivered into the PC burner even at low feed rates of fuel to the burner, the PC burner can be used over the entire range from maximum capacity down to zero energy output. The efficient controllability of the burner facilitates its use as a energy output regulating burner in solid-fuel fired plants.

Figure 4:
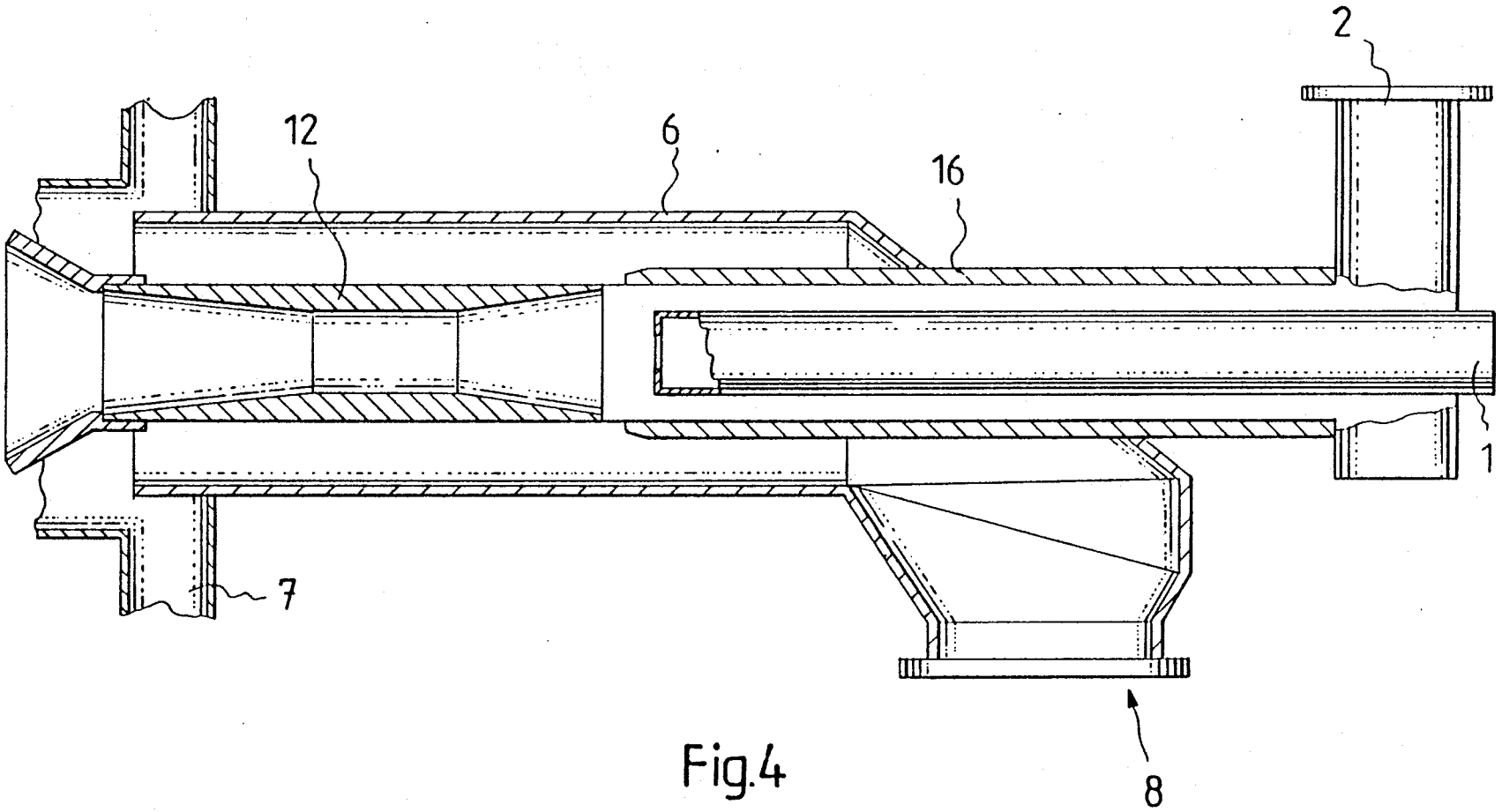
FIG. 4 shows an alternative embodiment of the present invention.
Figure 5:
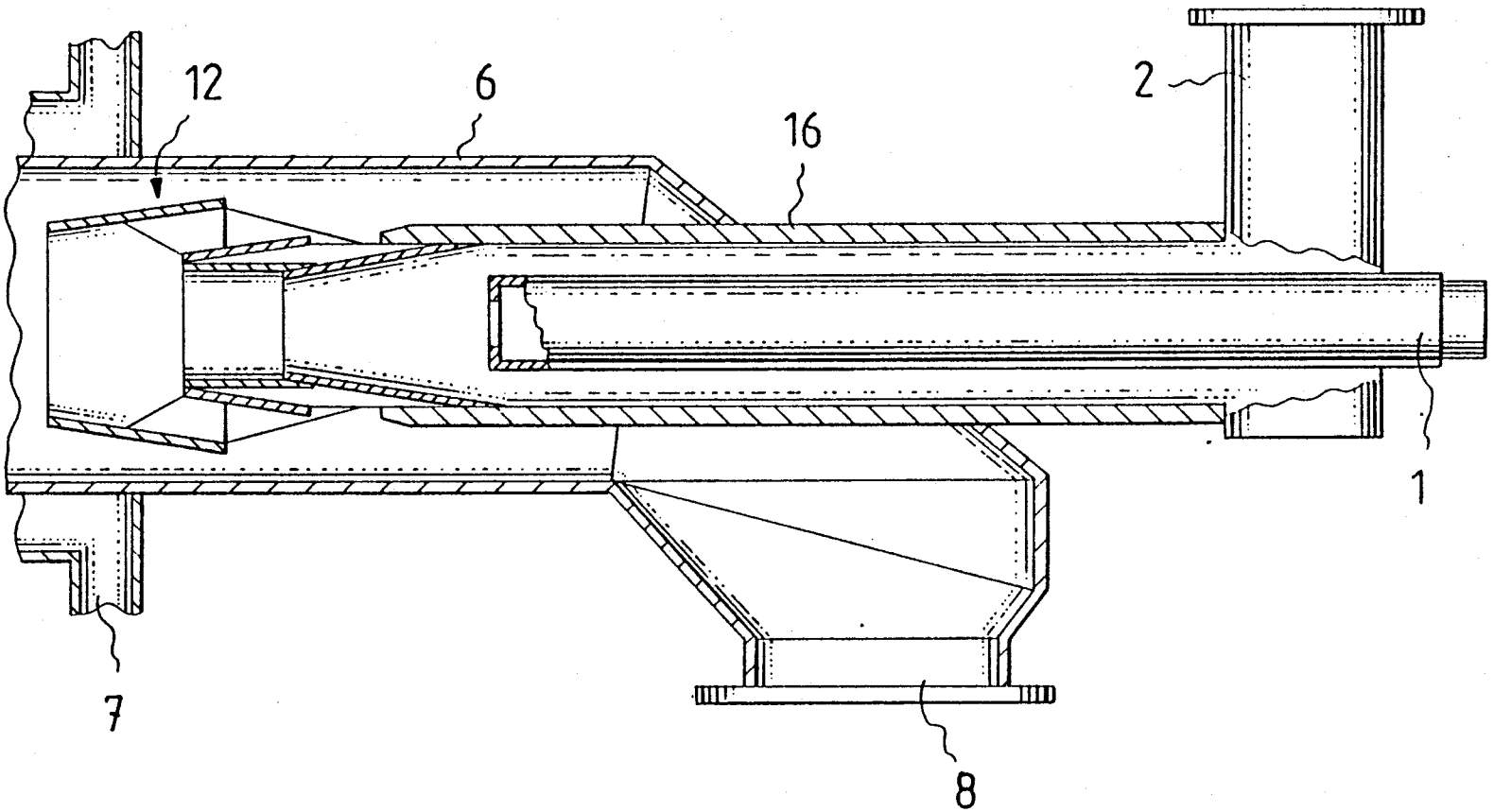
FIG. 5 shows a further alternative embodiment of the present invention.

Other alternative embodiments are also feasible within the scope of the invention. The shape of the nozzle 12 is thus varied in accordance with the desired characteristics of the igniting flame. Different kinds of nozzle constructions with defined characteristics are well known in the art, making the case-by-case dimensioning and adaptation of the nozzle easy in compliance with the laws of flow mechanics. Three different nozzle constructions are illustrated in FIGS. 3, 4 and 5. As evident from the figures, the position of the end of the nozzle 12 within the main burner 6 can be varied. The positioning of the nozzle 12 is dependent on the size and construction of the main burner 6 and the boiler.

Embodiments illustrated in FIGS. 4 and 5 have a simpler construction than that illustrated in FIG. 3. In the latter embodiments the end of the plasma torch 1 has been placed closer to the nozzle 12, and air is introduced into the auxiliary fuel only in two stages. The secondary air for the combustion process serving for gasification of the auxiliary fuel ignited by the plasma torch flame is taken along with the auxiliary fuel stream through an adaptor 2. The main fuel flow with carrier gas enters from a main fuel adapter 8, while the combustion air for the main fuel is taken through a combustion air adapter 7 of the main burner 6.

In the exemplifying embodiment, coal is used as the fuel of the auxiliary burner. By virtue of its low sulfur content and homogeneous quality, it is a preferred fuel for the auxiliary burner. Other possible fuels are, for instance, pulverized peat and wood chips, yet any fuel is usable that can be delivered into the burner by appropriate means.

The fuel can be fed into the auxiliary burner either using a curved adapter as described in the example, whereby the fuel is forced into a swirl motion about the center axis of the burner, or alternatively, in a linear motion parallel with the axis of the burner.

The plasma torch 1 can be powered with DC or AC, and the plasma-forming gas can be any suitable gas such as nitrogen, carbon dioxide, compressed air, etc., while the reduction of nitrogen oxides dictates a preference for the use of such a plasma-forming gas that in the later combustion stages forms single-atom radicals capable of dissociating the oxides of nitrogen. This kind of a gas is nitrogen for instance. The plasma torch 1 can be operated at a constant energy output, while a plasma torch 1 with controllable power allows further improvement in the adjustment and control possibilities of the PC burner. The energy output of the plasma torch 1 is designed according to the output capacity of the burner. The input power to the torch 1 is typically in the range 50 . . . 500 kW.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for starting a solid-fuel fired boiler and ensuring the burning process of the fuel, in which method the main fuel of the boiler is ignited and its burning is ensured by an auxiliary fuel torch flame where the auxiliary fuel can be identical to that used as the main fuel, comprising the steps of:

routing auxiliary fuel into an air-deficient gasification zone in the flame of a plasma torch burning in front of the torch, the auxiliary fuel is gasified there and partially combusted, therein allowing the combustion energy of the auxiliary fuel to gasify more auxiliary fuel;

controlling the degree of gasification of the auxiliary fuel by feeding air into the auxiliary fuel at least in one step;

igniting the gasified, partially burning and air-deficient mixture of auxiliary fuel by feeding air into the mixture; and entering the auxiliary fuel stream into the main fuel stream in order to ignite the main fuel.

2. The method in accordance with claim 1, wherein the plasma-forming gas is such a gas which can form radicals in the plasma flame that are capable of removing nitrogen oxides developed in the subsequent stages of the combustion process.

3. The method in accordance with claim 2, wherein the plasma-forming gas used is nitrogen.

4. The method in accordance with claim 1, wherein the auxiliary fuel is entered into the main fuel stream so as to make it proceed only in the direction of the center axis of the main fuel stream.

5. The method in accordance with claim 1, wherein the temperature of the gasification zone is locally above 3500° C.

6. The method in accordance with claim 1, wherein the auxiliary fuel is delivered via a duct in front of a plasma torch, where the auxiliary fuel is ignited and partially gasified, and the partially gasified auxiliary fuel is further entered through a nozzle into the fuel stream of a main burner.

7. The method in accordance with claim 1, wherein the auxiliary fuel is gasified and combusted in stages by entering air into the hot auxiliary fuel mixture in at least two different stages.

8. The method in accordance with claim 1, wherein the auxiliary fuel is entered into the main fuel stream so as to make it swirl about the center axis of the main fuel stream.

9. The method in accordance with claim 5, wherein the temperature of the gasification zone is locally above 4000° C.

10. An apparatus for starting a solid-fuel fired boiler and ensuring the burning process of the fuel, comprising:

a plasma torch and a main burner;

a body tube extending essentially coaxially with a center axis of the main burner, for feeding the auxiliary fuel into a main fuel stream;

a nozzle adapted to the boiler-side end of the body tube for feeding the auxiliary fuel stream into the main fuel stream;

a space between the plasma torch and the coaxially aligned body tube, for feeding the auxiliary fuel into the plasma flame burning in the space between the plasma torch and the body tube;

at least one air feed adapter for feeding air into the auxiliary fuel stream in order to control a degree of gasification thereof;

an air feed adapter for feeding secondary air into the air-deficient auxiliary fuel stream in order to achieve final ignition thereof.

11. The apparatus in accordance with claim 10, further comprising a feed adapter of the auxiliary fuel, adapted to envelop partially or entirely the body of the auxiliary burner.

12. The apparatus in accordance with claim 10, further comprising a feed adapter of the auxiliary fuel, coaxially adapted to the body of the auxiliary burner.

13. The apparatus in accordance with claim 10, wherein the body tube of the auxiliary burner is arranged to enter the space of the main burner through the wall of the main burner within a protective sheath.

14. The apparatus in accordance with claim 10, further comprising a feed tube for feeding the gasified auxiliary fuel into a nozzle.

* * * * *